US011847999B2

(12) United States Patent
Jia et al.

(10) Patent No.: US 11,847,999 B2
(45) Date of Patent: Dec. 19, 2023

(54) ONE-SHOT ACOUSTIC ECHO GENERATION NETWORK

(71) Applicant: Zoom Video Communications, Inc., San Jose, CA (US)

(72) Inventors: Zhaofeng Jia, Saratoga, CA (US); Yang Liu, Wetherby (GB); Qiyong Liu, Singapore (SG)

(73) Assignee: Zoom Video Communications, Inc., San Jose, CA (US)

( * ) Notice: Subject to any disclaimer, the term of this patent is extended or adjusted under 35 U.S.C. 154(b) by 0 days.

(21) Appl. No.: 17/512,509

(22) Filed: Oct. 27, 2021

(65) Prior Publication Data

US 2023/0100986 A1 Mar. 30, 2023

(51) Int. Cl.
*G10K 15/08* (2006.01)

(52) U.S. Cl.
CPC ..... *G10K 15/08* (2013.01)

(58) Field of Classification Search
CPC ..... G10K 11/20; G10K 15/02; G10K 15/08; H04S 7/305; H04S 2400/15; H04R 3/04; H04R 5/027; H04R 2227/005; H04R 2227/007
USPC ..... 381/61, 66, 92, 23, 22, 63, 56
See application file for complete search history.

(56) References Cited

U.S. PATENT DOCUMENTS

2008/0069366 A1* 3/2008 Soulodre ..... H04S 7/301 84/630
2009/0220100 A1* 9/2009 Ohta ..... H04S 7/305 381/63
2016/0093278 A1* 3/2016 Esparza ..... G01H 1/00 84/730

OTHER PUBLICATIONS

Kusha Sridhar et al. "ICASSP 2021 Acoustic Echo Cancellation Challenge: Datasets, Testing Framework and Results," in ICASSP 2021-2021 IEEE International Conference on Acoustics, Speech and Signal Processing (ICASSP), pp. 151-155. IEEE, 2021.

* cited by examiner

*Primary Examiner* — Norman Yu
(74) *Attorney, Agent, or Firm* — Kilpatrick Townsend & Stockton LLP

(57) ABSTRACT

Methods, systems, and apparatus, including computer programs encoded on computer storage media for generating echo recordings. The system receives, by an autoencoder, an audio signal representation that represents an audio signal and a target echo embedding that comprises information about a target room. The autoencoder comprises an encoder and a decoder. The system generates, by the encoder, a content embedding and an estimated echo embedding. The system generates, by the decoder, an echo recording representation based on the content embedding and the target echo embedding.

20 Claims, 11 Drawing Sheets

700

ONE-SHOT ACOUSTIC ECHO GENERATION NETWORK

FIELD

This application relates generally to machine learning, and more particularly, to systems and methods for generating audio recordings that simulate real-world data.

SUMMARY

The appended claims may serve as a summary of this application.

DETAILED DESCRIPTION OF THE DRAWINGS

Figure 1:
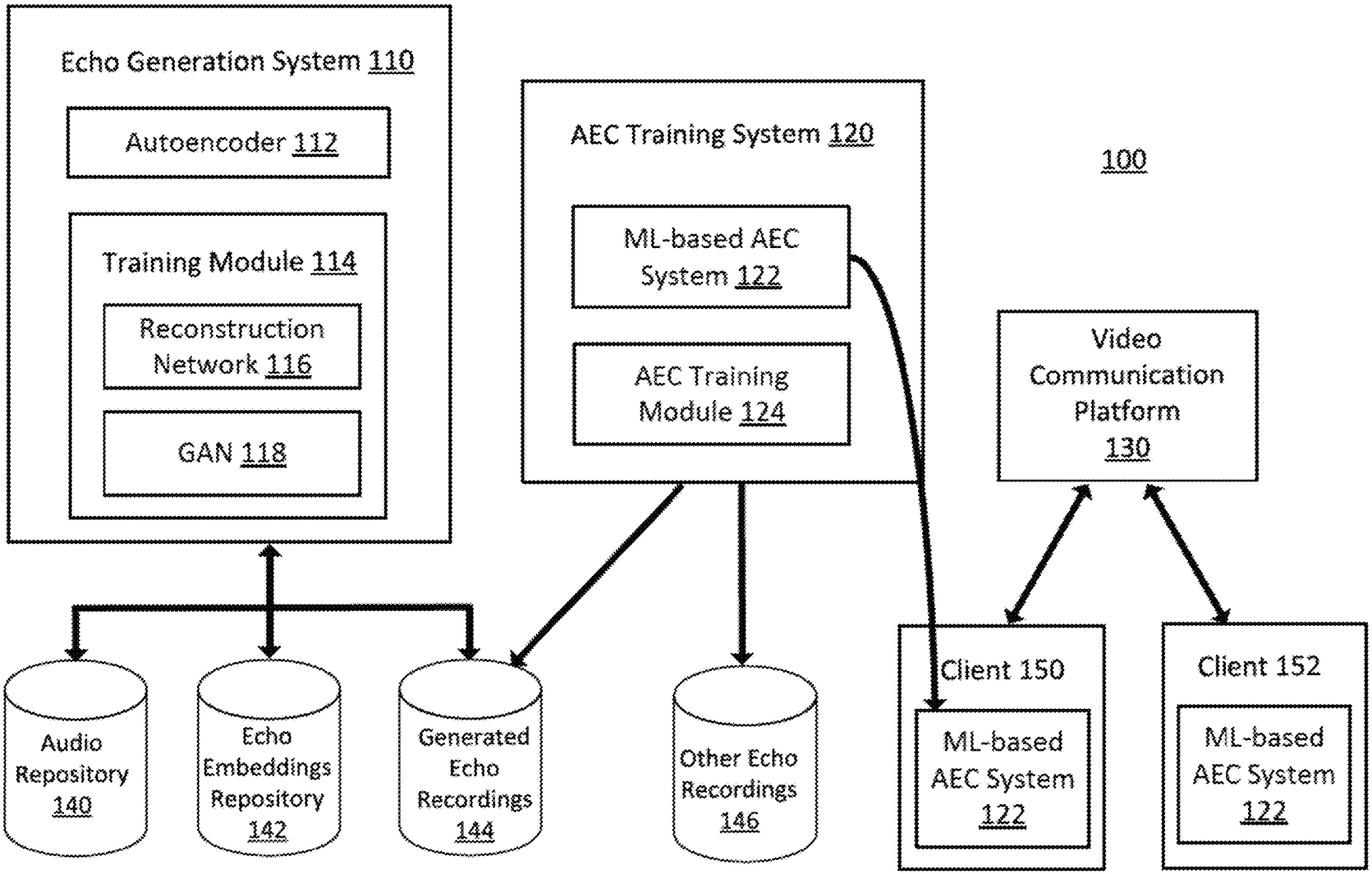
FIG. 1 is a diagram illustrating an exemplary network environment in which some embodiments may operate.

In this specification, reference is made in detail to specific embodiments of the invention. Some of the embodiments or their aspects are illustrated in the drawings.

For clarity in explanation, the invention has been described with reference to specific embodiments, however it should be understood that the invention is not limited to the described embodiments. On the contrary, the invention covers alternatives, modifications, and equivalents as may be included within its scope as defined by any patent claims. The following embodiments of the invention are set forth without any loss of generality to, and without imposing limitations on, the claimed invention. In the following description, specific details are set forth in order to provide a thorough understanding of the present invention. The present invention may be practiced without some or all of these specific details. In addition, well known features may not have been described in detail to avoid unnecessarily obscuring the invention.

In addition, it should be understood that steps of the exemplary methods set forth in this exemplary patent can be performed in different orders than the order presented in this specification. Furthermore, some steps of the exemplary methods may be performed in parallel rather than being performed sequentially. Also, the steps of the exemplary methods may be performed in a network environment in which some steps are performed by different computers in the networked environment.

Some embodiments are implemented by a computer system. A computer system may include a processor, a memory, and a non-transitory computer-readable medium. The memory and non-transitory medium may store instructions for performing methods and steps described herein.

I. Exemplary Environments

FIG. 1 is a diagram illustrating an exemplary network environment 100 in which some embodiments may operate. In the exemplary environment, echo generation system 110 may comprise a computer system for generating echo recordings. Echo generation system 110 may comprise an autoencoder 112 and a training module 114 for training autoencoder 112. Training module 114 may comprise a software module including reconstruction network 116 and a generative adversarial network (GAN) 118. In some embodiments, autoencoder 112, reconstruction network 116, and GAN 118 may comprise one or more neural networks, such as deep neural networks (DNNs). DNNs may use deep learning to implement one or more aspects of their functionality. Echo generation system 110 may be connected to one or more repositories and/or databases, including an audio repository 140, echo embeddings repository 142, and generated echo recordings repository 144. One or more of the databases may be combined or split into multiple databases.

The audio repository 140 may store one or more audio recordings, such as training samples for training the autoencoder 112, room reference samples for extracting echo embeddings, audio base samples to serve as base audio for generated echo recordings, and so on. Audio recordings in audio repository 140 may be used for one or more of these exemplary purposes. Echo embeddings repository 142 may store one or more echo embeddings. Echo embeddings may comprise digital representations of information about a room, such as information related to the generation of echo in the room. For example, echo embeddings may comprise information about the geometry and/or size of a room, one or more echo paths in the room, and so on. Geometry of the room may comprise information about layout and dimensions of the room and objects in the room that affect echo in the room. The room information encoded in the echo embeddings may be estimated from audio signals and are not required to be exact. Generated echo recordings repository 144 may store one or more echo recordings that are generated by the echo generation system 110.

In some embodiments, acoustic echo cancellation (AEC) training system 120 may use the generated echo recordings to train a machine learning (ML) based AEC system 122. AEC training system 120 may comprise a computer system that may be the same as, or separate from, the echo generation system 110. AEC training system 120 may comprise ML-based AEC system 122, which may comprise software stored in memory and/or computer storage and executed on one or more processors. In some embodiments, the ML-based AEC system 122 may comprise one or more neural networks, such as DNNs, for acoustic echo cancellation. Acoustic echo cancellation may comprise reducing or removing echo from one or more audio signals. ML-based AEC system 122 may comprise one or more internal weights (e.g., parameters) that may determine the operation of ML-based AEC system 122. The internal weights may be learned by training the ML-based AEC system 122 using the AEC training module 124, which may comprise a software module. For example, the internal weights may be learned by updating the weights through backpropagation in the ML-based AEC system 122 to minimize a loss function. ML-based AEC system 122 may be trained using the generated echo recordings from the generated echo recordings repository 144. ML-based AEC system 122 may also be trained using other echo recordings from other echo recordings repository 146, such as real-world echo recordings. Real-world echo recordings may be collected from controlled environments, such as lab recordings, or from actual user recordings, which may be considered wild recordings.

After training, the ML-based AEC system 122 may be deployed into video conferencing software on client device 150 and client device 152. Each client device may comprise a device with video conferencing software that includes ML-based AEC system 122 as a module, which may be used to perform acoustic echo cancellation during video conferences. Client device 150 and client device 152 are connected through video communication platform 130, which may comprise a computer system for performing backend functionality for the video conferencing software. Two client devices are illustrated, but in practice more or fewer client devices may be connected through video communication platform 130 for video conferencing. Each client device may participate in a video conference through the video communication platform 130. For example, each client device may comprise a device with a display for displaying a video conference and a microphone and speakers for transmitting and receiving audio information. The client device 150 and client device 152 may send and receive signals and/or information to the video communication platform 130. Each client device may be configured to perform functions related to presenting and playing back video, audio, documents, annotations, and other materials within a video presentation (e.g., a virtual class, lecture, webinar, or any other suitable video presentation) on the video communication platform 130. In some embodiments, client device 150 and client device 152 may include an embedded or connected camera which is capable of generating and transmitting video content in real time or substantially real time. For example, one or more of the client devices may be smartphones with built-in cameras, and the smartphone operating software or applications may provide the ability to broadcast live streams based on the video generated by the built-in cameras. In some embodiments, the client device 150 and client device 152 are computing devices capable of hosting and executing one or more applications or other programs capable of sending and/or receiving information. In some embodiments, the client device 150 and client device 152 may be a computer desktop or laptop, mobile phone, virtual assistant, virtual reality or augmented reality device, wearable, or any other suitable device capable of sending and receiving information. In some embodiments, the functionality of video communication platform 130 may be hosted in whole or in part as an application or web service executed on the client device 150 or client device 152. In some embodiments, one or more of the video communication platform 130, client device 150, client device 152, echo generation system 110, and AEC training system 120 may be the same device. In some embodiments, ML-based AEC system 122 may be deployed on video communication platform 130 in addition to or instead of on client devices, and ML-based AEC system 122 may perform acoustic echo cancellation of audio signals received from the client devices prior to transmitting the audio signals to other client devices. In some embodiments, first client device 150 is associated with a first user account on the video communication platform 130, and second client device 152 is associated with a second user account on the video communication platform 130.

Exemplary network environment 100 is illustrated with respect to a video communication platform 130 but may also include other applications such as audio calls, audio recording, video recording, podcasting, and so on. ML-based AEC system 122 that is trained using the generated echo recordings repository 144 and other echo recordings repository 146 may be used as a software module for acoustic echo cancellation in software applications for the aforementioned applications in addition to or instead of video communications.

As illustrated in exemplary network environment 100, echo generation system 110 may allow for generating echo recordings that are simulated and/or synthetic rather than collected from the real-world. Use of greater numbers of recordings as training samples for the ML-based AEC system 122 may be associated with improvements in performance and accuracy. Therefore, use of the generated echo recordings may produce improved results as compared to training the ML-based AEC system 122 only on real-world recordings. The use of echo generation system 100 may enable creating generated echo recordings with less labor and cost and increased efficiency. In addition, echo generation system 100 may reduce or eliminate the need for setting up simulation rooms according to complex parameters to simulate different environments.

By comparison, the training process for autoencoder 112 may be much less onerous. In some embodiments, autoencoder 112 may be trained using training module 114 based on audio recordings collected from the wild. Moreover, one-shot learning may be used by autoencoder 112 to extract information about a room into an echo embedding based on a single reference audio recording collected in the room. The echo embedding may be used to generate echo recordings that simulate audio recordings collected from the room.

Figure 2:
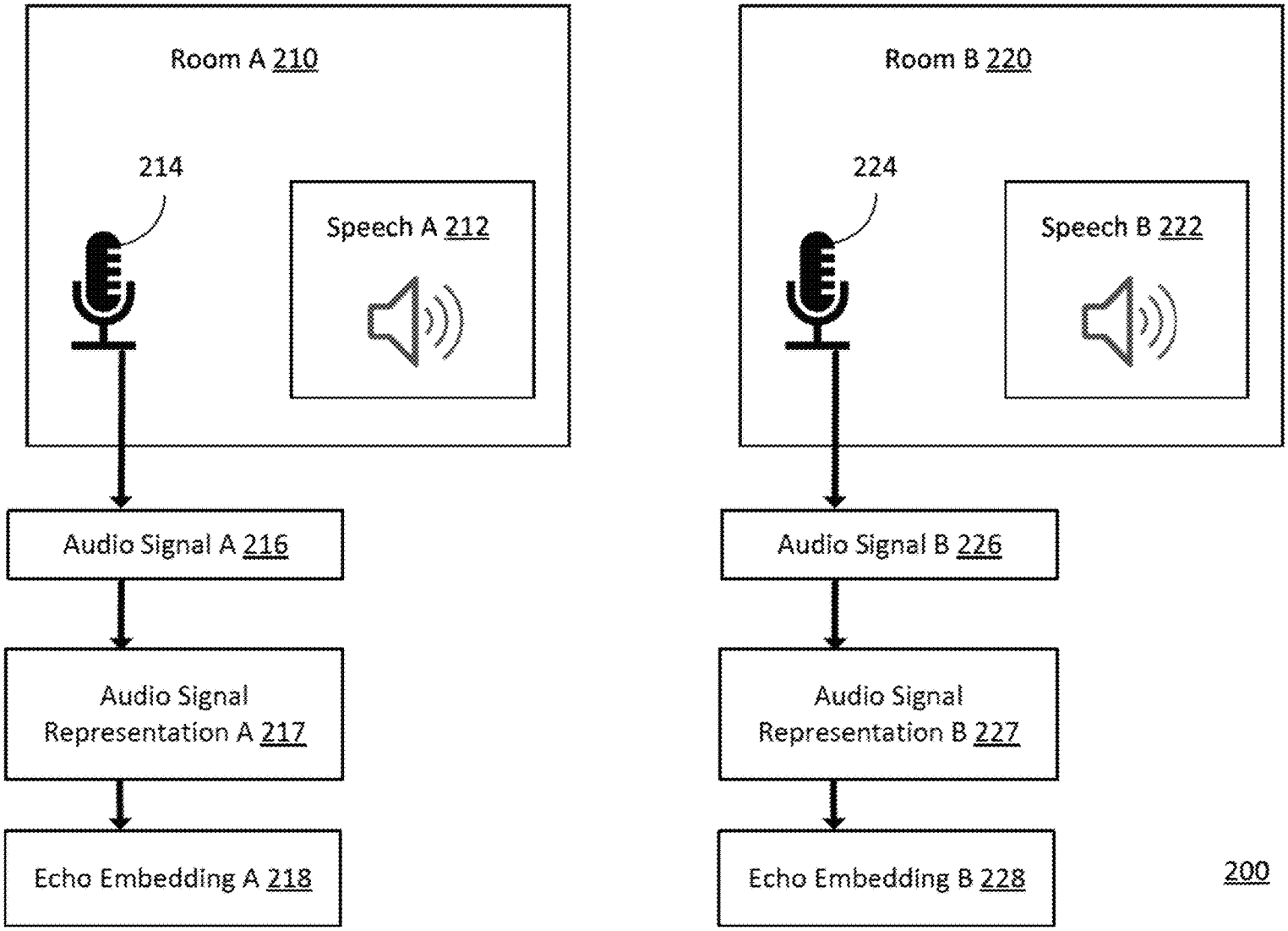
FIG. 2 is a diagram illustrating an exemplary environment in which some embodiments may operate.

FIG. 2 is a diagram illustrating an exemplary environment 200 in which some embodiments may operate. Speech sample A 212, which may comprise an audio recording from audio repository 140, plays in room A 210 and is recorded by microphone 214 in room A 210 to generate audio signal A 216. Audio signal A 216 may be converted into an audio signal representation A 217, such as a spectrogram or other representation. The audio signal representation A 217 may be input to autoencoder 112 to generate echo embedding A 218.

Similarly, speech sample B 222, which may comprise an audio recording from audio repository 140, plays in room B 220 and is recorded by microphone 224 in room B 220 to generate audio signal B 226. Audio signal B 226 may be converted into an audio signal representation B 227, such as a spectrogram or other representation. The audio signal representation B 227 may be input to autoencoder 112 to generate echo embedding B 218.

Using methods described further herein, echo generation system 110 may be used to generate an echo recording to simulate speech sample A being played in room B 220, including estimated echo from room B 220, and an echo recording to simulate speech sample B being played in room A 210, including estimated echo from room A 210.

II. Exemplary System

Autoencoder

Figure 3:
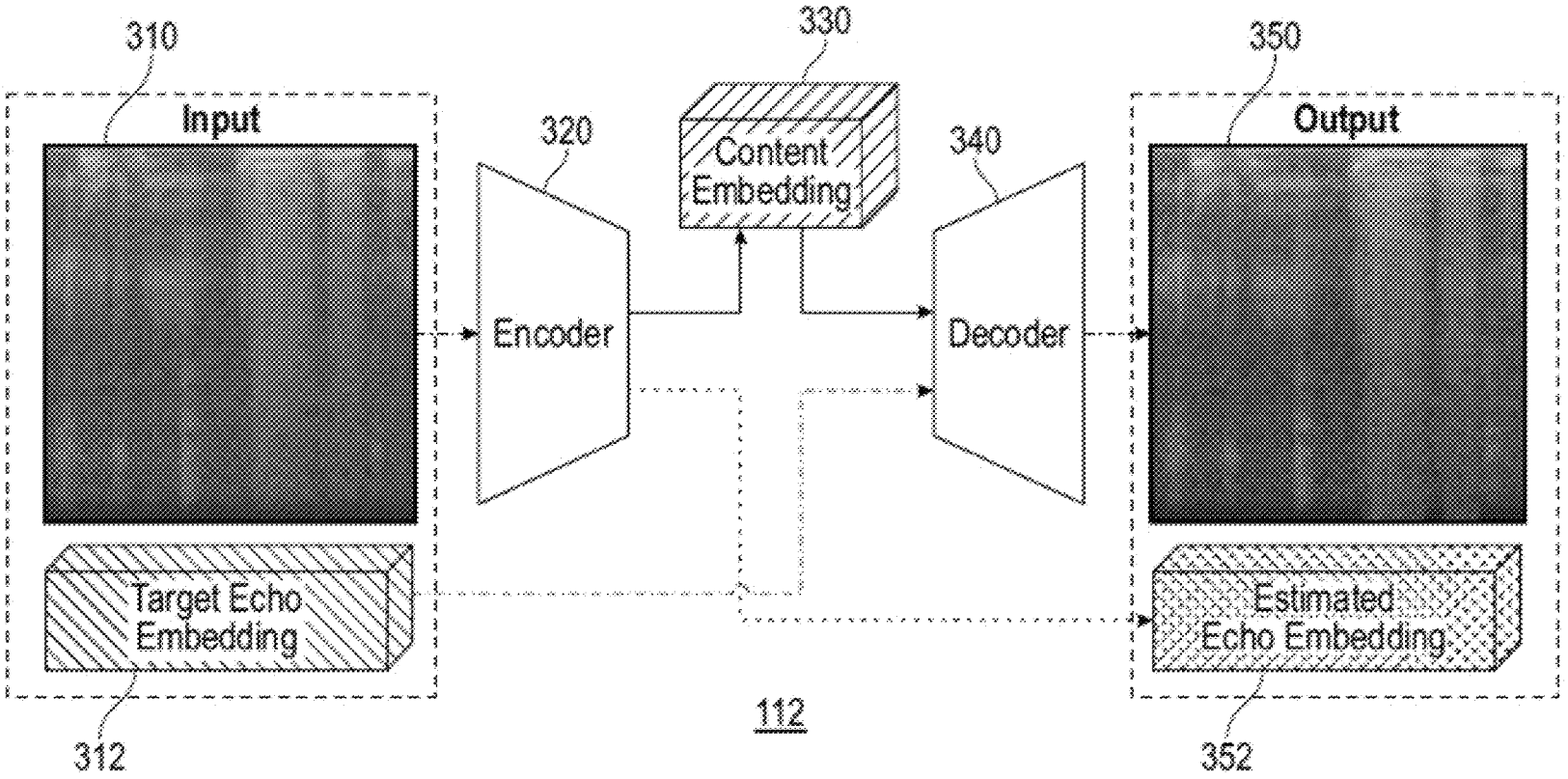
FIG. 3 is a diagram illustrating an exemplary autoencoder according to one embodiment of the present disclosure.

FIG. 3 is a diagram illustrating an exemplary autoencoder 112 according to one embodiment of the present disclosure.

Autoencoder 112 may comprise an encoder 320 and decoder 340. Audio signal representation 310 and target echo embedding 312 may be input to autoencoder 112. The audio signal representation 310 may comprise a digital representation of an audio signal that is suitable for processing by autoencoder 112. For example, the audio signal representation 310 may comprise a spectrogram generated by performing the Short-time Fourier Transform (STFT) on an audio signal. The audio signal may comprise an audio recording from audio repository 140, such as a speech recording. In an embodiment, the spectrogram may comprise a two-dimensional vector where a first dimension represents time, a second dimension represents frequency, and each value represents the amplitude or magnitude of a particular frequency at a particular time. In exemplary audio signal representation 310, different values may be represented by different color intensities. Alternatively, audio signal representation 310 may comprise other features of the audio signal, such as magnitude of STFT, magnitude and phase of STFT, real and imaginary components of STFT, energy, log energy, mel spectrum, mel-frequency cepstral coefficients (MFCC), combinations of these features, and other features. In some embodiments, audio signal representation 310 may be represented by a spectrogram of one or more of these features.

Encoder 320 and decoder 340 may each comprise neural networks, such as DNNs. In one embodiment, the autoencoder 112 may comprise a Vector Quantized Variational Autoencoder (VQ-VAE). The encoder 320 and decoder 340 may each comprise a plurality of nodes, each having one or more weights, where the weights are learned by training. The encoder 320 and decoder 340 may be trained together using reconstruction loss and/or GAN discriminator loss as described herein.

Audio signal representation 310 may be input to encoder 320 to generate content embedding 330 and estimated echo embedding 352. Content embedding 330 may comprise a digital representation of information about the content of the audio signal, such as voice speech or other content such as sounds or music. Estimated echo embedding 352 may comprise a digital representation of information about the room where the audio signal was recorded, such as information related to the generation of echo in the room. In some embodiments, embeddings may comprise low-dimensional, learned vector representations that may be used to generate higher-dimensional vector representations of information, such as by autoencoder 112. In some embodiments, embeddings encode information in a compressed, space-efficient format. For example, the embeddings may represent information with a vector representation that is smaller than the input to the encoder 320. Embeddings may be lossy and may lose some amount of data in the process of encoding.

Content embedding 330 and target echo embedding 312 may be input to decoder 340. Target echo embedding 312 may comprise an echo embedding for a target room. In particular, target echo embedding 312 may comprise information about the target room, such as information related to the generation of echo in the target room. Decoder 340 generates echo recording representation 350 based on the content embedding 330 and target echo embedding 312. In an embodiment, the decoder 340 may combine the content from content embedding 330 with the room information contained in target echo embedding 312 and decode the resulting combination containing both content and room information to generate the echo recording representation 350. The echo recording representation 350 may comprise a representation of an estimated audio signal that estimates the audio signal being played in the target room, including the estimated echo from the target room. The format of echo recording representation 350 may comprise a spectrogram or other features of an audio signal as described with respect to audio signal representation 310 or elsewhere herein.

Echo recording representation 350 may be converted to an echo recording by performing the inverse of the function used to generate the audio signal representation. When the echo recording representation 350 is an STFT representation, the echo recording may be generated by performing the inverse-STFT (iSTFT) on the echo recording representation 350. The iSTFT function may use both magnitude and phase information. In one embodiment, the same phase information of the audio signal representation 310 may be used for the iSTFT of the echo recording representation 350 based on an assumption that they have the same phase.

With the encoder N, the input spectrum $S_E$ is decomposed to a content embedding C 330 and an echo embedding $\hat{E}$ 352. $S_E$ is the spectrum S with echo embedding E. The encoder network can be represented as $$\{C,\hat{E}\}=N(S_E)$$

With the decoder D, the content embedding C 330 and echo embedding E 312 are used to generate the spectrum $\widehat{S_{E'}}$. The decoder network can be represented as:

$$\widehat{S_{E'}}=D(C,\hat{E})$$

If the target echo embedding 312 and estimated echo embedding 352 are the same, the autoencoder 112 becomes a reconstruction network that reconstructs audio signal representation 310 into echo recording representation 350. For example, when the target echo embedding 312 is the same as the estimated echo embedding 352, then the audio signal representation 310 is the same as the echo recording representation 350. Otherwise, when the echo embeddings are not the same, the autoencoder 112 may comprise an echo generation network. The autoencoder 112 may be trained using two objective functions, a reconstruction loss and discriminator loss.

In an embodiment, the autoencoder 112 may be used in two steps. In a first step, a first audio signal is converted to a first audio signal representation and input to the autoencoder 112 along with a first echo embedding. The autoencoder 112 generates first estimated echo embedding that represents information about the room that first audio signal was recorded in. In a second step, a second audio signal is converted to a second audio signal representation and input to the autoencoder 112 along with the first estimated echo embedding. The autoencoder 112 generates a second echo recording representation. The second echo recording representation may be converted, such as by iSTFT, to a generated echo recording that represents an estimate of the second audio signal played in the room where the first audio signal was recorded.

The use of autoencoder 112 may be illustrated with respect to exemplary environment 200. In a first step, audio signal representation A217 and an arbitrary echo embedding (such as a random echo embedding) may be input to autoencoder 112 to generate echo embedding A 218. The autoencoder 112 may also generate an echo recording representation that does not need to be used in this example. Since the autoencoder 112 generates echo embedding A 218 that represents information about room A 210 using just a single input example (e.g., audio signal representation A 217), the autoencoder 112 may be said to operate in one-shot and be an instance of one-shot learning. In a second step, audio signal representation B 227 and echo embedding A 218 may be input to autoencoder 112 to generate an echo recording representation. The echo recording representation may be converted, such as by iSTFT, to an echo recording, which estimates speech sample B 222 played in room A 210 and recorded from microphone 214, including the estimated echo from room A 210 that would be recorded. The autoencoder 112 may also generate echo embedding B 228, which may similarly be input to the autoencoder 112 with audio signal representation A 217 to obtain an echo recording that estimates speech sample A 212 played in room B 220.

In an embodiment, room A 210 and room B 220 may optionally be rooms in the wild, such as from user data or an audio recording dataset. For example, audio signal A 216 and audio signal B 226 may be recordings from user data, such as audio collected from a videoconference of one or more users. The room information is extracted automatically by the autoencoder 112 into echo embedding A 218 and echo embedding B 228 without the echo generation system 110 or autoencoder 112 directly observing or measuring room A 210 or room B 220. Alternatively, room A 210 and room B 220 may be simulation rooms that are set up to simulate particular environments, and audio signal A 216 and audio signal B 226 may be recorded in the simulation rooms.

Training

Figure 4:
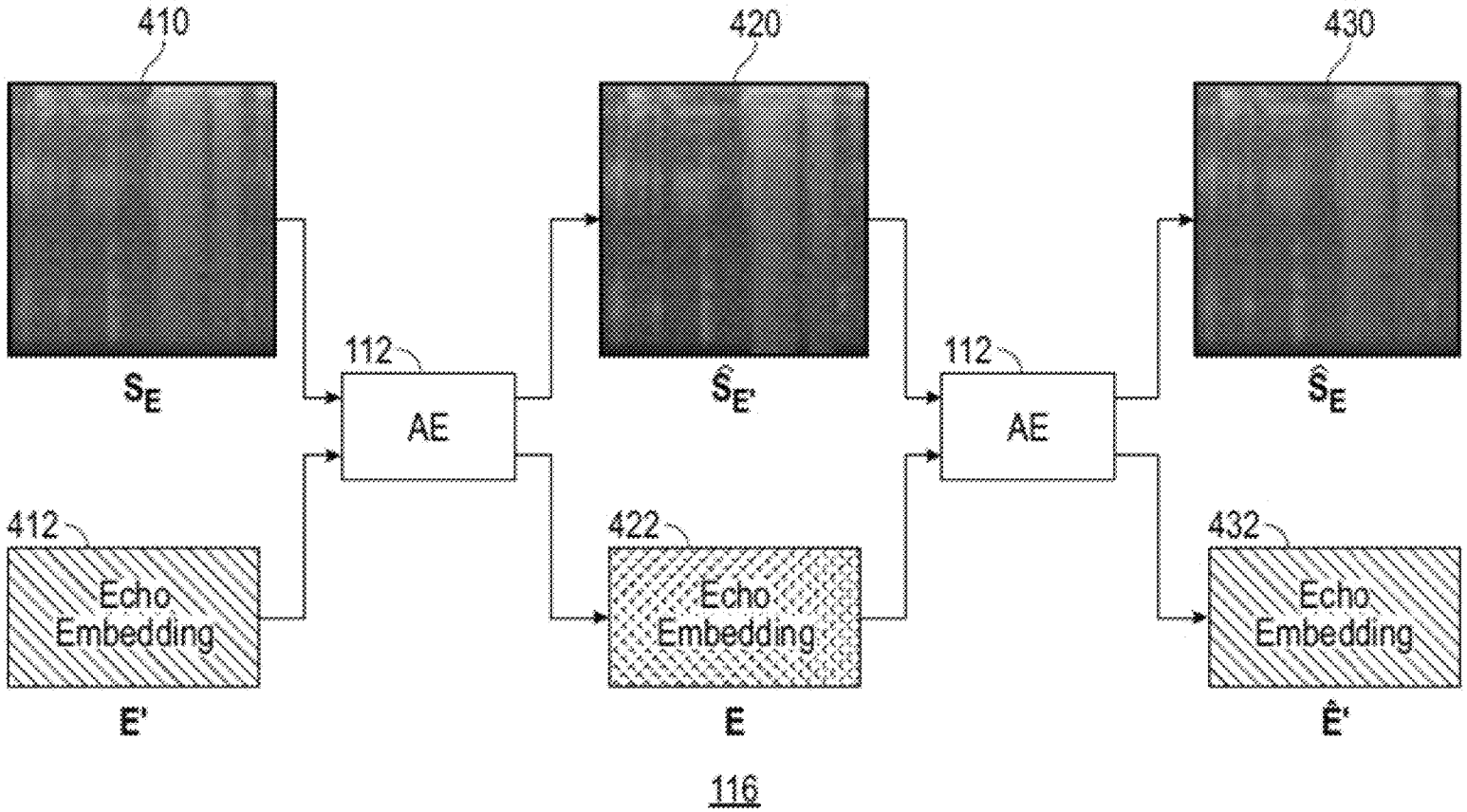
FIG. 4 is a diagram illustrating an exemplary reconstruction network according to one embodiment of the present disclosure.

FIG. 4 is a diagram illustrating an exemplary reconstruction network 116 according to one embodiment of the present disclosure. Reconstruction network 116 may comprise a Siamese reconstruction network including two autoencoders 112 that have the same structure and share the same internal weights. Reconstruction network 116 may be used to learn and update the weights of the autoencoder 112 using reconstruction loss to train autoencoder 112 for generating echo recordings and echo embeddings as illustrated in FIG. 3 and elsewhere herein.

Audio signal representation 410 and echo embedding 412 may be input to the first autoencoder 112. In some embodiments, audio signal representation 410 may comprise an arbitrary audio recording from the wild, such as a user audio recording from video communication platform 130. Alternatively, audio signal representation 410 may be collected from an audio recording dataset or simulation room. Echo embedding 412 may comprise an arbitrary echo embedding, such as a random echo embedding.

The first autoencoder 112 generates, based on the audio signal representation 410 and echo embedding 412, the intermediate audio signal representation 420 and intermediate echo embedding 422. The intermediate audio signal representation 420 may represent the audio signal representation 410 including estimated echo according to arbitrary echo embedding 412, and the intermediate echo embedding 422 may represent the room information from audio signal representation 410.

The intermediate audio signal representation 420 and intermediate echo embedding 422 are input to the second autoencoder 112 to generate the echo recording representation 430 and estimated echo embedding 432. The echo recording representation 430 represents the audio signal of audio signal representation 410 including estimated echo according to the room where the audio signal was recorded. The estimated echo embedding 432 represents the room information from intermediate audio signal representation 420, which was generated by the first autoencoder 112 using arbitrary echo embedding 412. Accordingly, the reconstruction network 116, and the autoencoders 112 comprising the reconstruction network 116, may be trained by evaluating the error between the audio signal representation 410 and echo embedding 412 that are input to the reconstruction network 116 and the echo recording representation 430 and estimated echo embedding 432 that are output, respectively. For example, in some embodiments, the error between the audio signal representation 410 and echo recording representation 430 and the error between the echo embedding 412 and estimated echo embedding 432 are calculated and summed, and the sum comprises the overall error. This overall error may comprise a loss function. Training may comprise updating weights of the autoencoder 112 by backpropagation to minimize the error, which may be expressed as a loss function. In some embodiments, the error may comprise Mean Squared Error (MSE), Mean Absolute Error (MAE), or other loss functions. The error or loss function for the reconstruction network 116 may be referred to as the reconstruction loss.

$S_E$ may comprise a spectrum in the training dataset. E may comprise a random echo embedding. $\widehat{S_{E'}}$ and $\widehat{S_{E'}}$ comprise the generated spectrum with the echo embedding E' and estimated echo embedding E. With the two auto-encoder networks 112, the reconstruction network is setup.

The network then takes source spectrum $S_E$ and target echo embedding E' as input and generates $\widehat{S_{E'}}$ and $\hat{E}'$. E and E' may be used as ground truth to supervise the training in this reconstruction task. The objective for this reconstruction network may comprise:

$$L_{roc}(S_E,E')=(\|S_E-\hat{S}_E\|_1+\|E'-\hat{E}'\|_1)$$

$L_{roc}(S_E, E')$ may be represented as $L_{roc}(S_E)$, since E' is given and fixed in each epoch.

In an embodiment, training autoencoder 112 via reconstruction loss using reconstruction network 116 enables training to be performed without ground truth information, such as ground truth echo embeddings that encode real room information. The reconstruction network 116 may be trained with audio signals from the wild, such as user recordings, without having corresponding ground truth room information or ground truth echo embeddings for the audio signals. The reconstruction network 116 may be trained without information about the rooms where the training audio samples were recorded, such as without measurement, layout, dimension, geometry, or echo path information.

Figure 5:
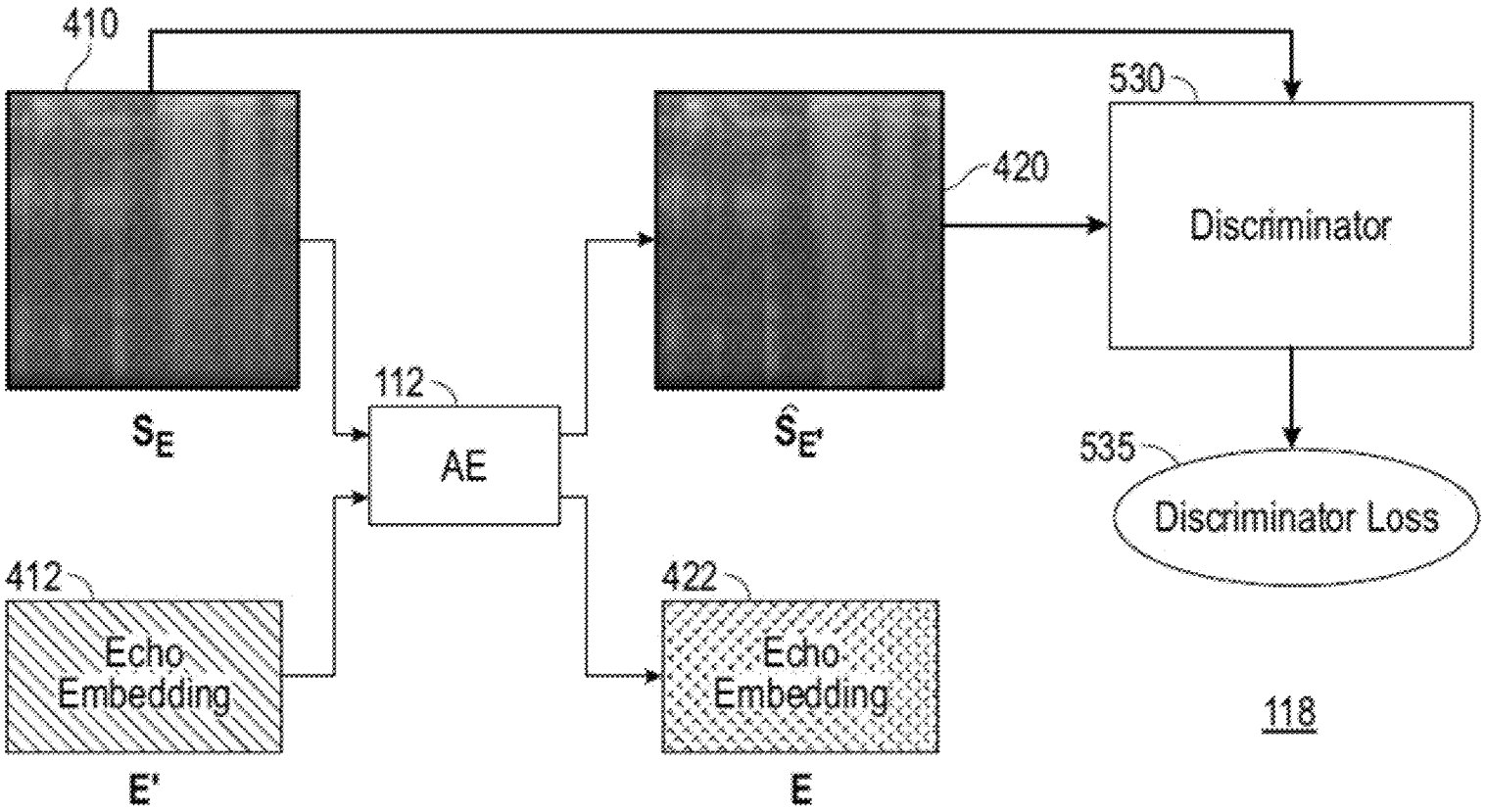
FIG. 5 is a diagram illustrating an exemplary GAN according to one embodiment of the present disclosure.

FIG. 5 is a diagram illustrating an exemplary GAN 118 according to one embodiment of the present disclosure. GAN 118 may be used to learn and update the weights of the autoencoder 112 using discriminator loss. In an embodiment, GAN 118 may comprise a Wasserstein GAN with gradient penalty (WGAN-GP), wherein discriminator 530 may comprise a critic.

In some embodiments, reconstruction network 116 may not necessarily include a constraint on intermediate audio signal representation 420 that it comprises a distribution similar to a real-world audio signal representation. Training only with reconstruction network 116 may produce generated audio signal representations from autoencoder 112 that do not look realistic. GAN 118 may train autoencoder 112 to produce output that appears more similar to a real-world audio signal representation, such as by having a similar distribution. Training with GAN 118 to minimize discriminator loss may improve the quality of the generated echo recording representation 350. In some embodiments, the reconstruction loss and discriminator loss may be combined in a loss function to minimize both errors during training. For example, the overall loss may be the sum of the reconstruction loss and discriminator loss. Backpropagation may be used to update the weights of the autoencoder 112 to minimize the overall loss function.

During training with reconstruction network 116, audio signal representation 410 and echo embedding 412 are input to the first autoencoder 112 to generate intermediate audio signal representation 420 and intermediate echo embedding 422. The audio signal representation 410 and intermediate audio signal representation 420 are input to discriminator 530. Discriminator 530 may comprise a neural network, such as a DNN, that is trained to determine which of the two inputs is the real-world audio signal representation 410 and which is the generated intermediate audio signal representation 420 from the first autoencoder 112. The discriminator loss function 535 may measure the ability of the discriminator 530 to choose correctly (e.g., discriminate) between the two audio signal representations. Minimizing discriminator loss function 535 may correlate to the discriminator 530 doing more poorly in discriminating between the two audio signal representations and the autoencoder 112 generating echo recording representations that are more similar to real-world audio signal representations. In WGAN-GP, the discriminator 530 may comprise a critic that scores the realness or fakeness of the audio signal representations.

In an embodiment, GAN 118, comprising a WGAP-GP, is applied to force the distribution of local spectrum patches in intermediate audio signal representation 420 to be close to that of a natural spectrum. The objective function may comprise:

$$L_{dis}(S_E)=N_{S_E}R(D(N(S_E),E'))^2-N_{S_E}(R(S_E))^2$$

Where R comprises the critic (discriminator 530) of the GAN 118. The overall loss for the network may comprise the sum of the reconstruction loss and the discriminator loss. First, the network is trained where there are six down-sampling layers and eight residual blocks. Then the embedding passes through three residual blocks and two residual blocks with a fully connected layer to obtain the content embedding and echo embedding, respectively. Then these embeddings are added after several residual blocks. Finally, a generated echo spectrum is generated after six up-sampling layers. Therefore, six skip layers may be added between the down-sampling and up-sampling layers. The network may be trained, for example, using a gradient-based optimization algorithm. Finally, the generated spectrum may convert to audio signals, such as with iSTFT.

III. Exemplary Methods

Figure 6:
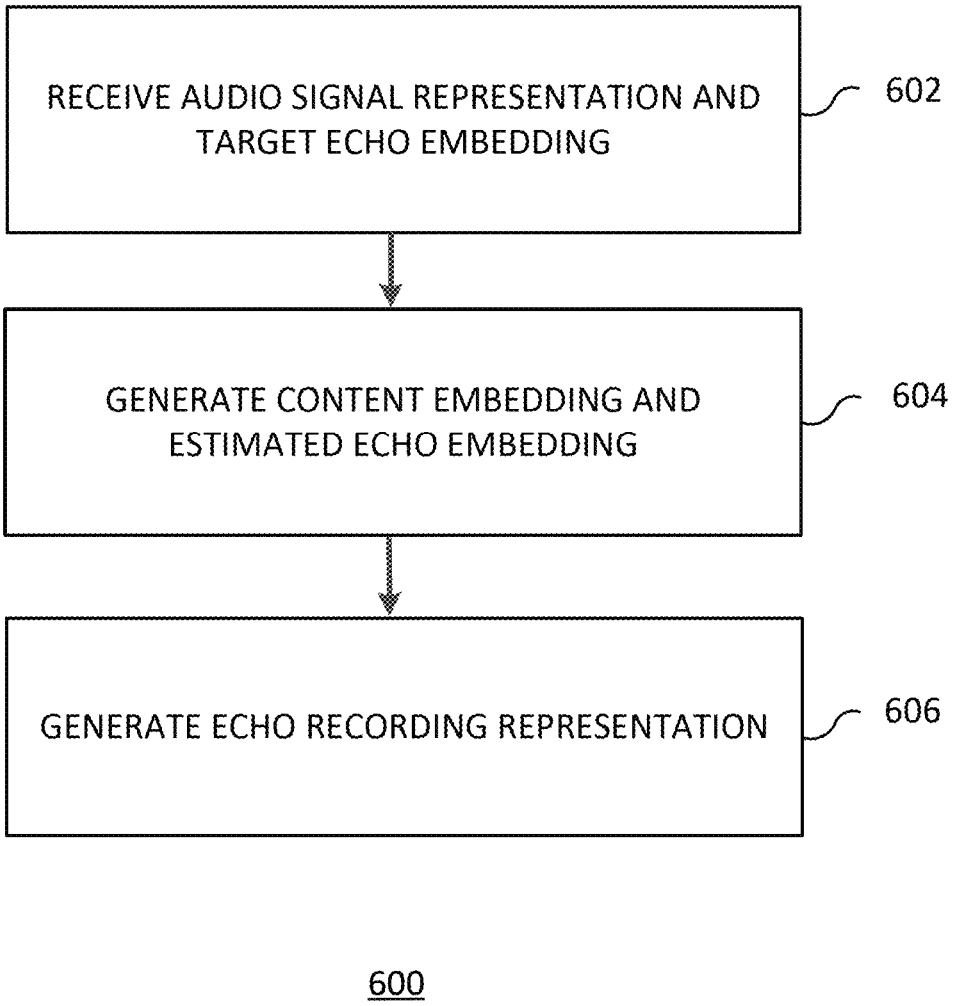
FIG. 6 is a flow chart illustrating an exemplary method that may be performed in some embodiments.

FIG. 6 is a flow chart illustrating an exemplary method 600 that may be performed in some embodiments.

At step 602, an autoencoder 112 receives an audio signal representation 310 that represents an audio signal and a target echo embedding 312 that comprises information about a target room. The autoencoder may comprise an encoder 320 and a decoder 340. In an embodiment, the audio signal may comprise a speech recording and the audio signal representation 310 may comprise an STFT of the audio signal or other audio features. In an embodiment, the target echo embedding encodes information about the geometry of the target room and one or more echo paths. In an embodiment, the target echo embedding is generated by inputting into the autoencoder a second audio signal representation that represents a second audio signal that was recorded in the target room.

At step 604, the encoder 320 generates a content embedding 330 and an estimated echo embedding 352. The content embedding 330 may comprise a digital representation of information about the content of the audio signal, and the estimated echo embedding 352 may comprise a digital representation of information about the room where the audio signal was recorded. In an embodiment, the encoder 320 may comprise a neural network, such as a DNN.

At step 606, the decoder 340 generates an echo recording representation 350 based on the content embedding 330 and the target echo embedding 312. In an embodiment, the decoder 340 may combine the content from content embedding 330 with the room information contained in target echo embedding 312 and decode the resulting combination containing both content and room information to generate the echo recording representation 350. The echo representation 350 may represent the audio signal including estimated echo from playing in the target room. In an embodiment, the decoder 340 may comprise a neural network, such as a DNN.

In some embodiments, when the target echo embedding 312 is the same as the estimated echo embedding 352, then the audio signal representation 310 is the same as the echo recording representation 350. In some embodiments, when the target echo embedding 312 is similar to the estimated echo embedding 352, then the audio signal representation 310 may be similar to the echo recording representation 350.

In some embodiments, an echo recording may be generated from the echo recording representation 350. The echo recording may be used for training an acoustic echo cancellation system 122.

In some embodiments, the autoencoder 112 comprises one or more weights that are learned by training the autoencoder 112 in a Siamese reconstruction network 116. The Siamese reconstruction network 116 may comprise two copies of the autoencoder in series, wherein an output of the first copy of the autoencoder comprises an input to the second copy of the autoencoder. The Siamese reconstruction network 116 may be trained to minimize reconstruction loss between an input audio signal representation and input echo embedding of the Siamese reconstruction network 116 and an output audio signal representation and output echo embedding of the Siamese reconstruction network 116. In an embodiment, the autoencoder 112 may be trained to minimize discriminator loss using a GAN 118.

Figure 7:
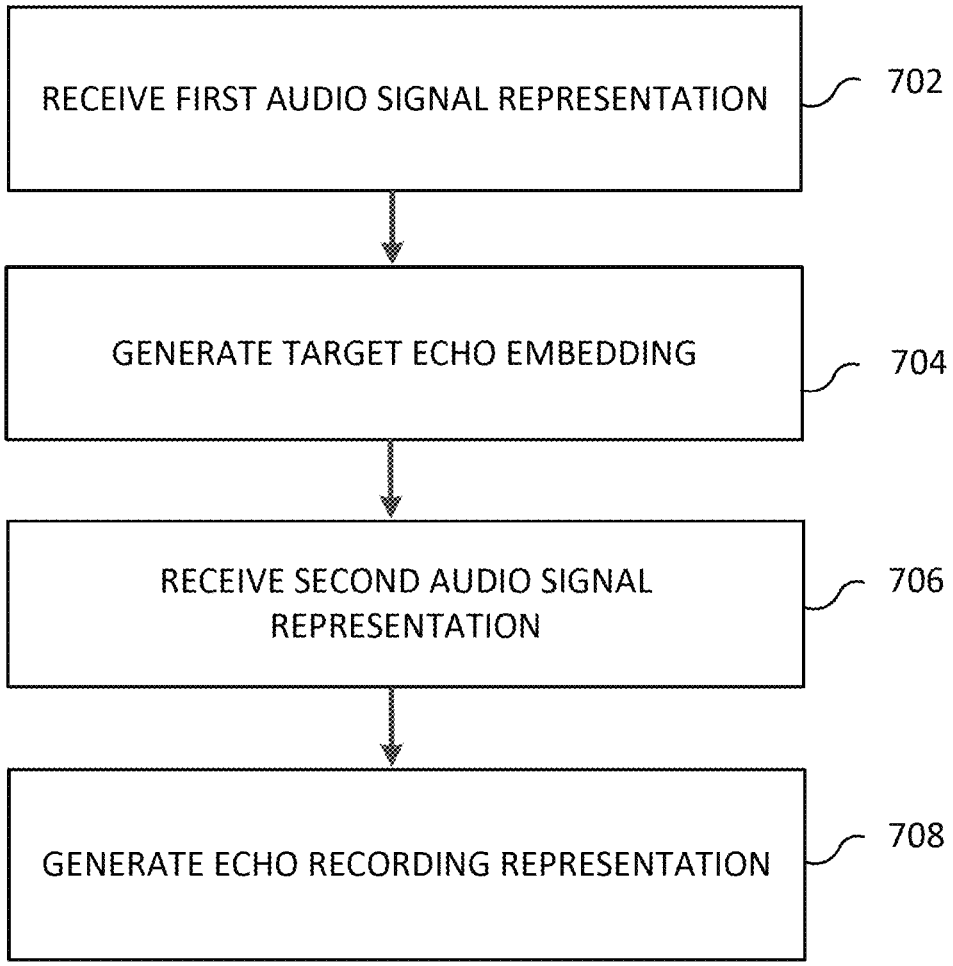
FIG. 7 is a flow chart illustrating an exemplary method that may be performed in some embodiments.

FIG. 7 is a flow chart illustrating an exemplary method 700 that may be performed in some embodiments.

At step 702, an autoencoder 112 receives a first audio signal representation that represents a first audio signal and a first echo embedding. The autoencoder may comprise an encoder 320 and a decoder 340. In an embodiment, the first audio signal may comprise a speech recording and the first audio signal representation may comprise an STFT of the first audio signal or other audio features. In an embodiment, the first echo embedding may be an arbitrary embedding, such as a random echo embedding.

At step 704, the autoencoder 112 generates a target echo embedding that comprises information about the room where the first audio signal was recorded. The autoencoder 112 may optionally generate an echo recording representation that represents the first audio signal including estimated echo based on the first echo embedding.

At step 706, the autoencoder 112 receives a second audio signal representation that represents a second audio signal and the target echo embedding. In an embodiment, the second audio signal may comprise a speech recording and the second audio signal representation may comprise an STFT of the second audio signal or other audio features. The second audio signal may be different from the first audio signal.

At step 708, the autoencoder 112 generates an echo recording representation based on the second audio signal representation and the target echo embedding. In an embodiment, the autoencoder 112 may combine the audio content from second audio signal representation with the room information contained in target echo embedding to generate the echo recording representation. The echo recording representation may represent the second audio signal including estimated echo from playing in the room where the first audio signal was recorded. The autoencoder 112 may optionally generate an estimated echo embedding that represents information about the room where the second audio signal was recorded.

Figure 8A:
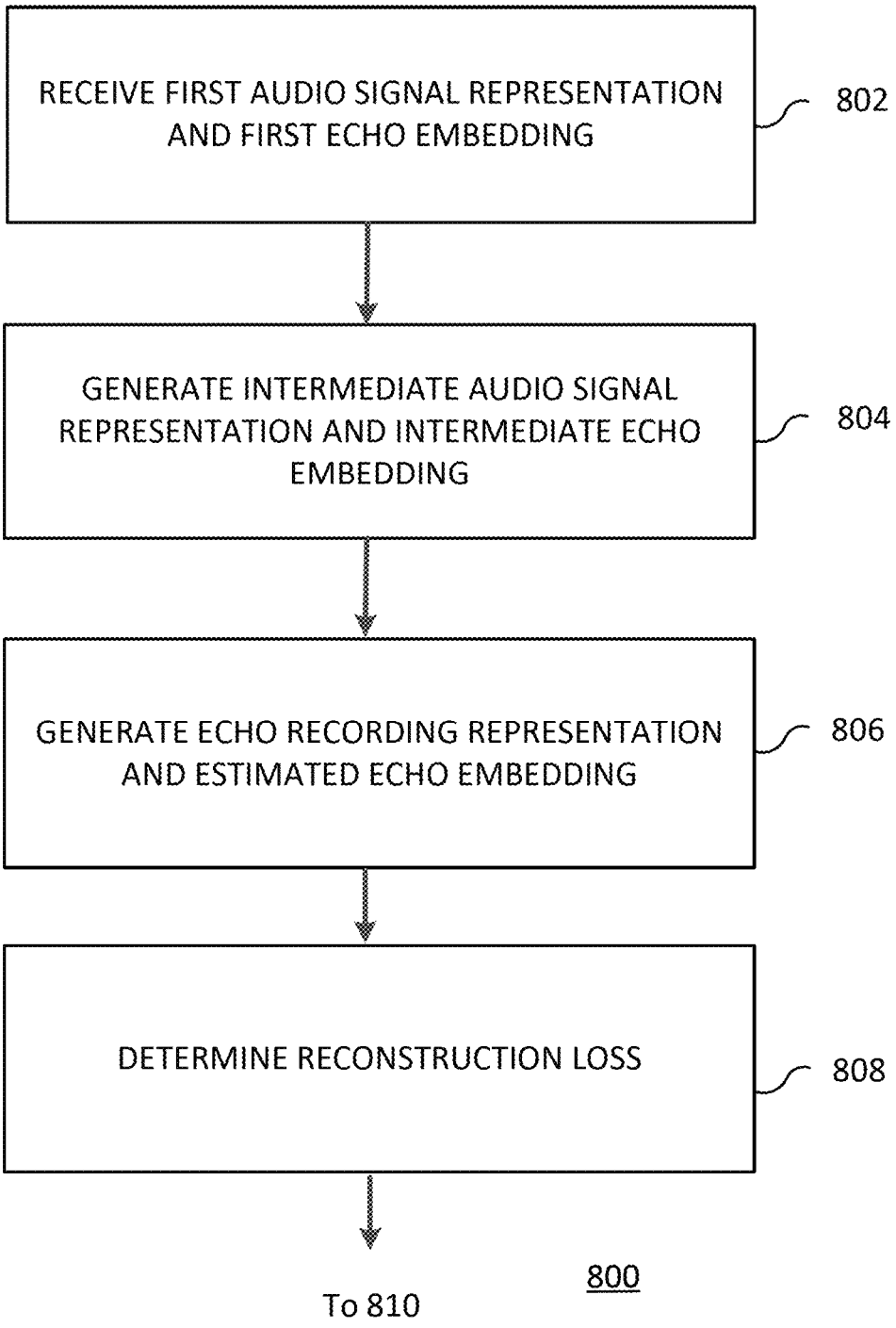
FIGS. 8A-8B are a flow chart illustrating an exemplary method that may be performed in some embodiments.
Figure 8B:
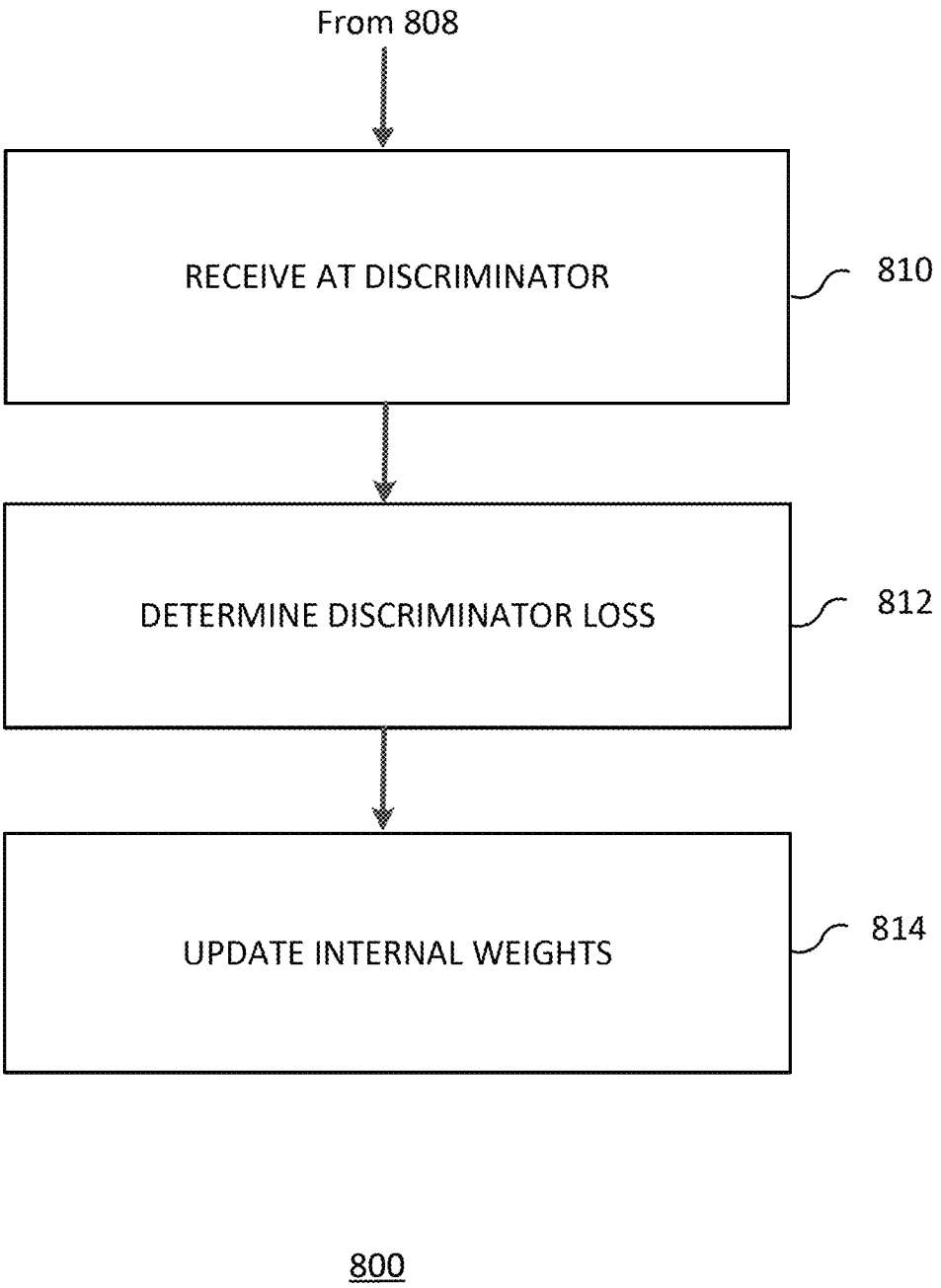

FIGS. 8A-8B are a flow chart illustrating an exemplary method 800 that may be performed in some embodiments.

At step 802, a reconstruction network 116 receives a first audio signal representation 410 that represents a first audio signal and a first echo embedding 412, wherein the reconstruction network 116 comprises a first autoencoder and second autoencoder that share the same structure and share the same internal weights. In an embodiment, the first audio signal may comprise a speech recording and the first audio signal representation 410 may comprise an STFT of the first audio signal or other audio features. In an embodiment, the first echo embedding 412 may be an arbitrary embedding, such as a random echo embedding.

At step 804, the first autoencoder generates, based on the first audio signal representation 410 and first echo embedding 412, an intermediate audio signal representation 420 and intermediate echo embedding 422. The first autoencoder receives as input the first audio signal representation 410 and first echo embedding 412. In an embodiment, the intermediate audio signal representation 420 may represent the audio signal representation 410 including estimated echo as if it was played in the room encoded by first echo embedding 412, and the intermediate echo embedding 422 may represent the room information from audio signal representation 410.

At step 806, the second autoencoder generates, based on the intermediate echo recording representation 420 and intermediate echo embedding 422, an echo recording representation 430 and an estimated echo embedding 432. The second autoencoder receives as input the intermediate echo recording representation 420 and the intermediate echo embedding 422 that are output by the first autoencoder. In an embodiment, the echo recording representation 430 represents the first audio signal of first audio signal representation 410 including estimated echo according to the room where the first audio signal was recorded. The estimated echo embedding 432 represents the room information from intermediate audio signal representation 420, which was generated by the first autoencoder 112 using first echo embedding 412.

At step 808, reconstruction loss is determined based on the difference between the echo recording representation 430 and the first audio signal representation 410 and the difference between the estimated echo embedding 432 and the first echo embedding 412. In an embodiment, the reconstruction loss comprises the sum of the error between the echo recording representation 430 and the first audio signal representation 410 and between the estimated echo embedding 432 and the first echo embedding 412. The error may be comprise MSE, MAE, or other loss functions.

At step 810, a discriminator 530 receives the first audio signal representation 410 and the intermediate audio signal representation 420. Discriminator 530 may be a component of a GAN 118 and may comprise a neural network, such as a DNN. Discriminator 530 may be trained to differentiate between real-world audio signal representations and generated audio signal representations.

At step 812, the discriminator 530 determines a discriminator loss based on the ability of the discriminator to discriminate between the first audio signal representation 410 and the intermediate audio signal representation 420. In an embodiment, the discriminator 530 may try to discriminate between the first audio signal representation 410 and the intermediate audio signal representation 420 to determine which comprises a real-world audio signal representation and which comprises a generated audio signal representation. In an embodiment, the discriminator 530 may comprise a critic that scores how real or fake the first audio signal representation 410 and the intermediate audio signal representation 420 appear to be.

At step 814, one or more internal weights of the first autoencoder and second autoencoder are updated based on the reconstruction loss and the discriminator loss. In an embodiment, an overall loss function comprises the sum of the reconstruction loss and the discriminator loss, and the one or more internal weights of the first autoencoder and second autoencoder are updated to minimize the overall loss function, such as by using a gradient-based optimization algorithm.

Figure 9:
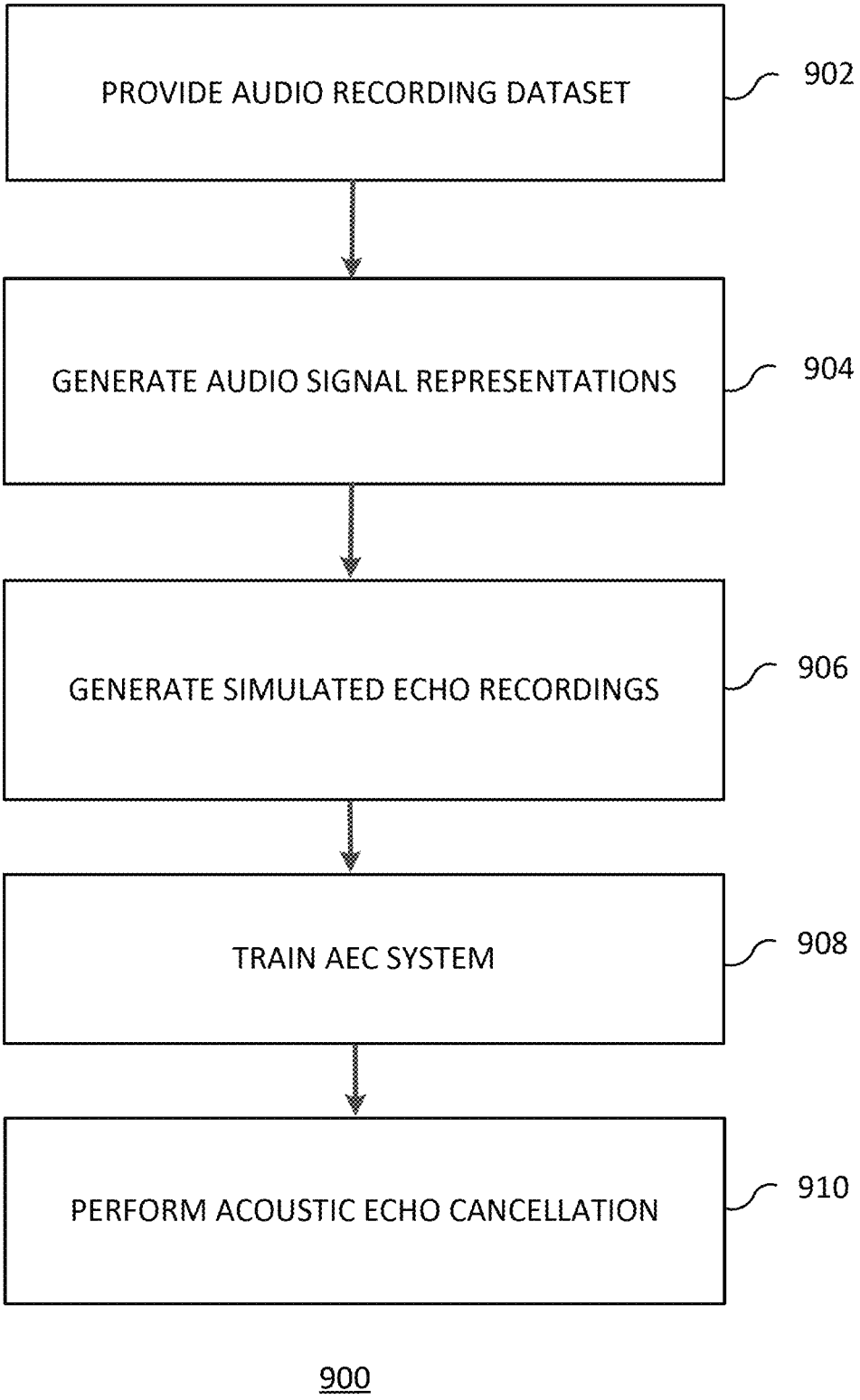
FIG. 9 is a flow chart illustrating an exemplary method that may be performed in some embodiments.

FIG. 9 is a flow chart illustrating an exemplary method 900 that may be performed in some embodiments.

At step 902, an audio recording dataset is provided comprising one or more audio signals. In an embodiment, the audio signals may comprise speech recordings, such as wild speech recordings (e.g., user audio recordings), speech recordings from an audio recording dataset, speech recordings collect from simulation rooms, or other types of speech recordings. The audio signals may be recorded in a plurality of different rooms.

At step 904, a plurality of audio signal representations are generated based on the audio recording dataset. The audio signal representations may comprise STFTs or other audio features of the audio signals.

At step 906, the plurality of audio signal representations are input to an echo generation system 110 to generate one or more simulated echo recordings 144. The echo generation system 110 may comprise an autoencoder 112. In an embodiment, one or more audio signal representations comprise room reference representations that were recorded in a variety of different rooms that are representative of environments where a target software application may be used. The room reference representations may be input to autoencoder 112 of echo generation system 110 to generate a plurality of echo embeddings. In an embodiment, one or more audio signal representations comprise audio base representations that comprise speech for training. The audio base representations may be input to the autoencoder 112 of the echo generation system 110 with selected echo embeddings to generate simulated echo recordings 144 that include a variety of different speech audio that are simulated being recorded in a variety of different rooms.

At step 908, an ML-based AEC system 122 is trained based on the one or more simulated echo recordings 144. Optionally, the ML-based AEC system 122 may also be trained on other echo recordings 146. The ML-based AEC system 122 may comprise a neural network, such as a DNN. In an embodiment, ML-based AEC system 122 may comprise one or more internal weights that are updated to minimize a loss function based on a gradient-based optimization algorithm.

At step 910, acoustic echo cancellation of an audio recording from a user is performed by the ML-based AEC system 122. In an embodiment, the ML-based AEC system 122 may process the audio recording using its neural network, such as a DNN, to perform acoustic echo cancellation to remove or reduce echo in an audio recording from the user. In an embodiment, the audio recording from the user may comprise real-time audio from a videoconference that is recorded by videoconferencing software. For example, ML-based AEC system 122 on client 150 may perform acoustic echo cancellation on the audio recording prior to transmitting the audio recording to video communication platform 130 or other client 152.

IV. Variants

Systems and methods herein may also be used to generate audio recordings with other types of information such as noise, speech enhancement, and other types of sound or enhancements. For example, systems and methods herein may be used for de-noising audio recording and for speech enhancement. Target echo embedding 312 may be replaced by a noise embedding or a speech enhancement embedding to encode noise or speech enhancement information, respectively, and add the noise or speech enhancement to an audio signal.

In one embodiment, autoencoder 112 may generate noise recordings that represent an audio signal with added noise. An audio signal representation that represents an audio signal and target noise embedding may be input to autoencoder 112. The noise embedding may comprise a digital representation of target noise.

The audio signal representation may be input to encoder 320 to generate content embedding and estimated noise embedding. Content embedding may comprise a digital representation of information about the content of the audio signal. Estimated noise embedding may comprise a digital representation of the noise in the audio signal.

Content embedding and target noise embedding may be input to decoder 340. Decoder 340 generates a noise recording representation based on the content embedding and the target noise embedding. In an embodiment, the decoder 340 may combine the content from the content embedding with the noise information contained in the target noise embedding and decode the resulting combination containing both content and noise information to generate the noise recording representation. The noise recording representation may comprise a representation of an estimated audio signal that estimates the audio signal being played with the target noise. The noise recording representation may be converted to a noise recording by performing the inverse function used to generate the audio signal representation.

In an embodiment, the autoencoder 112 may be used in two steps. In a first step, a first audio signal is converted to a first audio signal representation and input to the autoencoder 112 along with a first noise embedding. The autoencoder 112 generates first estimated noise embedding that represents information about the noise in first audio signal. In a second step, a second audio signal is converted to a second audio signal representation and input to the autoencoder 112 along with the first estimated noise embedding. The autoencoder 112 generates a second noise recording representation. The second noise recording representation may be converted, such as by iSTFT, to a generated noise recording that represents an estimate of the second audio signal played with the noise from the first audio signal.

In one embodiment, autoencoder 112 may generate speech enhancement recordings that represent an audio signal with added speech enhancement. An audio signal representation that represents an audio signal and target speech enhancement embedding may be input to autoencoder 112. The target speech enhancement embedding may comprise a digital representation of a target speech enhancement.

The audio signal representation may be input to encoder 320 to generate content embedding and estimated speech enhancement embedding. Content embedding may comprise a digital representation of information about the content of the audio signal. Estimated speech enhancement embedding may comprise a digital representation of speech enhancement in the audio signal.

Content embedding and target speech enhancement embedding may be input to decoder 340. Decoder 340 generates a speech enhancement recording representation based on the content embedding and the target speech enhancement embedding. In an embodiment, the decoder 340 may combine the content from the content embedding with the speech enhancement information contained in the target speech enhancement embedding and decode the resulting combination containing both content and speech enhancement information to generate the speech enhancement recording representation. The speech enhancement recording representation may comprise a representation of an estimated audio signal that estimates the audio signal being played with the speech enhancement. The speech enhancement recording representation may be converted to a speech enhancement recording by performing the inverse function used to generate the audio signal representation.

In an embodiment, the autoencoder 112 may be used in two steps. In a first step, a first audio signal is converted to a first audio signal representation and input to the autoencoder 112 along with a first speech enhancement embedding. The autoencoder 112 generates first estimated speech enhancement embedding that represents information about speech enhancement in the first audio signal. In a second step, a second audio signal is converted to a second audio signal representation and input to the autoencoder 112 along with the first estimated speech enhancement embedding. The autoencoder 112 generates a second speech enhancement recording representation. The second speech enhancement recording representation may be converted, such as by iSTFT, to a generated speech enhancement recording that represents an estimate of the second audio signal played with the speech enhancement from the first audio signal.

Autoencoder 112 may be trained to generate noise recording representations and speech enhancement recording representations using reconstruction network 116 and GAN 118 using reconstruction loss and/or discriminator loss as described herein. Generated noise recordings and generated speech enhancement recordings may be used to train a ML-based de-noising system and ML-based speech enhancement system, respectively, which may each comprise neural networks. The generated noise recordings and generated speech enhancement recordings may be used as training data for the ML-based de-noising system and ML-based speech enhancement system, respectively. Both systems may comprise software modules in videoconferencing software on clients 150, 152 or video communication platform 130 and may be used to de-noise and enhance speech during videoconferences or may be used for other applications such as audio calls, audio recording, video recording, podcasting, and so on.

Exemplary Computer System

Figure 10:
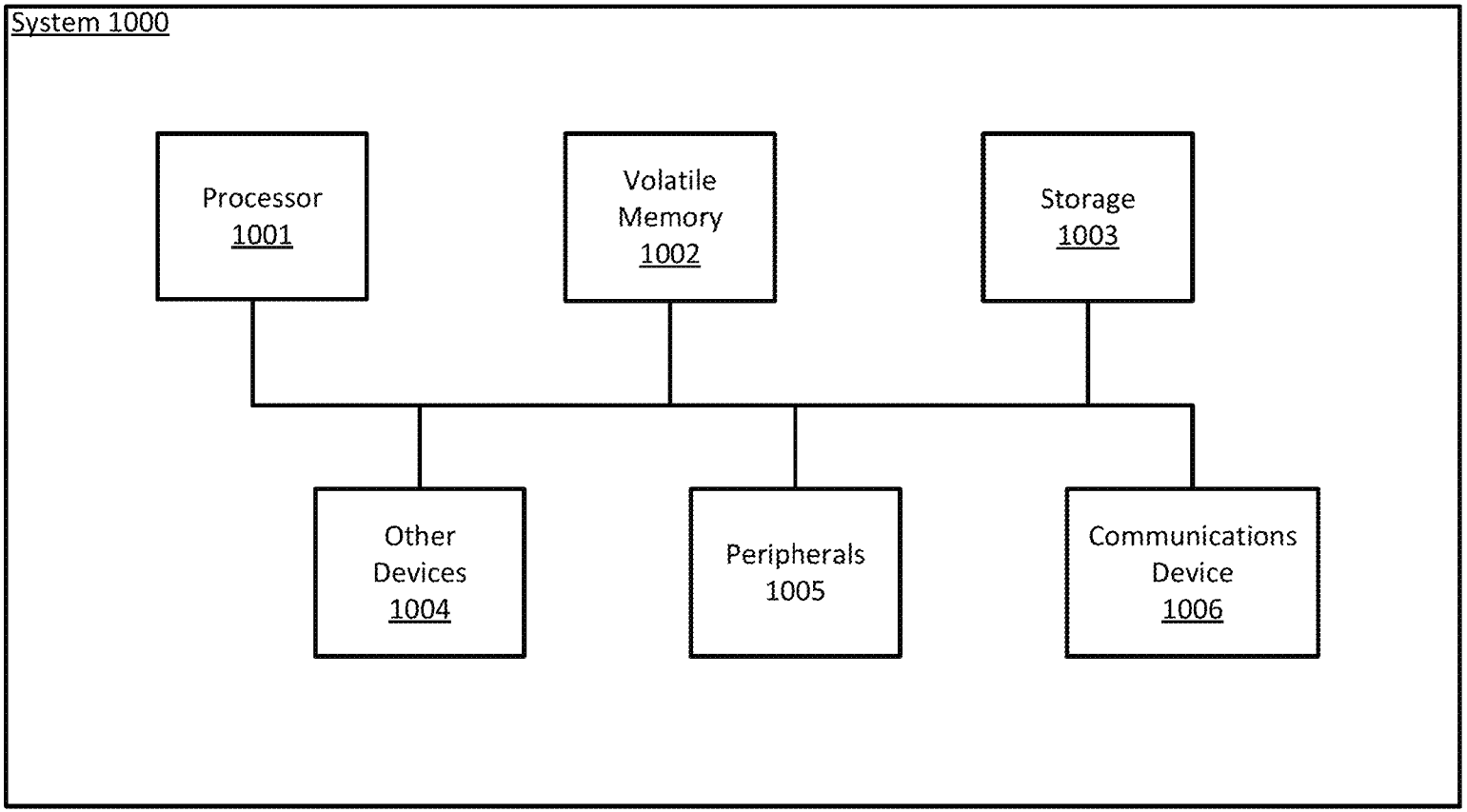
FIG. 10 illustrates an exemplary computer system wherein embodiments may be executed.

FIG. 10 is a diagram illustrating an exemplary computer that may perform processing in some embodiments. Exemplary computer 1000 may perform operations consistent with some embodiments. The architecture of computer 1000 is exemplary. Computers can be implemented in a variety of other ways. A wide variety of computers can be used in accordance with the embodiments herein.

Processor 1001 may perform computing functions such as running computer programs. The volatile memory 1002 may provide temporary storage of data for the processor 1001. RAM is one kind of volatile memory. Volatile memory typically requires power to maintain its stored information. Storage 1003 provides computer storage for data, instructions, and/or arbitrary information. Non-volatile memory, which can preserve data even when not powered and including disks and flash memory, is an example of storage. Storage 1003 may be organized as a file system, database, or in other ways. Data, instructions, and information may be loaded from storage 1003 into volatile memory 1002 for processing by the processor 1001.

The computer 1000 may include peripherals 1005. Peripherals 1005 may include input peripherals such as a keyboard, mouse, trackball, video camera, microphone, and other input devices. Peripherals 1005 may also include output devices such as a display. Peripherals 1005 may include removable media devices such as CD-R and DVD-R recorders/players. Communications device 1006 may connect the computer 1000 to an external medium. For example, communications device 1006 may take the form of a network adapter that provides communications to a network. A computer 1000 may also include a variety of other devices 1004. The various components of the computer 1000 may be connected by a connection medium such as a bus, crossbar, or network.

It will be appreciated that the present disclosure may include any one and up to all of the following examples.

Example 1: A computer-implemented method for echo recording generation, comprising: receiving, by an autoencoder, an audio signal representation that represents an audio signal and a target echo embedding that comprises information about a target room, wherein the autoencoder comprises an encoder and a decoder; generating, by the encoder, a content embedding and an estimated echo embedding; generating, by the decoder, an echo recording representation based on the content embedding and the target echo embedding; and wherein the echo recording representation represents the audio signal including estimated echo from playing in the target room.

Example 2: The method of Example 1, wherein the target echo embedding encodes information about the geometry of the target room and one or more echo paths.

Example 3: The method of any Examples 1-2, wherein when the target echo embedding is the same as the estimated echo embedding, then the audio signal representation is the same as the echo recording representation.

Example 4: The method of any Examples 1-3, wherein the target echo embedding is generated by inputting into the autoencoder a second audio signal representation that represents a second audio signal that was recorded in the target room.

Example 5: The method of any Examples 1-4, wherein the autoencoder comprises one or more weights that are learned by training the autoencoder in a Siamese reconstruction network.

Example 6: The method of claim any Examples 1-5, wherein the Siamese reconstruction network comprises two copies of the autoencoder in series, wherein an output of the first copy of the autoencoder comprises an input to the second copy of the autoencoder.

Example 7: The method of claim any Examples 1-6, wherein the Siamese reconstruction network is trained to minimize reconstruction loss between an input audio signal representation and input echo embedding of the Siamese reconstruction network and an output audio signal representation and output echo embedding of the Siamese reconstruction network.

Example 8: A non-transitory computer readable medium that stores executable program instructions that when executed by one or more computing devices configure the one or more computing devices to perform operations comprising: receiving, by an autoencoder, an audio signal representation that represents an audio signal and a target echo embedding that comprises information about a target room, wherein the autoencoder comprises an encoder and a decoder; generating, by the encoder, a content embedding and an estimated echo embedding; generating, by the decoder, an echo recording representation based on the content embedding and the target echo embedding; and wherein the echo recording representation represents the audio signal including estimated echo from playing in the target room.

Example 9: The non-transitory computer readable medium of Example 8, wherein the target echo embedding encodes information about the geometry of the target room and one or more echo paths.

Example 10: The non-transitory computer readable medium of any Examples 8-9, wherein when the target echo embedding is the same as the estimated echo embedding, then the audio signal representation is the same as the echo recording representation.

Example 11: The non-transitory computer readable medium of any Examples 8-10, wherein the target echo embedding is generated by inputting into the autoencoder a second audio signal representation that represents a second audio signal that was recorded in the target room.

Example 12: The method of any Examples 8-11, wherein the autoencoder comprises one or more weights that are learned by training the autoencoder in a Siamese reconstruction network.

Example 13: The non-transitory computer readable medium of any Examples 8-12, wherein the Siamese reconstruction network comprises two copies of the autoencoder in series, wherein an output of the first copy of the autoencoder comprises an input to the second copy of the autoencoder.

Example 14: The non-transitory computer readable medium of any Examples 8-13, wherein the Siamese reconstruction network is trained to minimize reconstruction loss between an input audio signal representation and input echo embedding of the Siamese reconstruction network and an output audio signal representation and output echo embedding of the Siamese reconstruction network.

Example 15: An echo recording generation system comprising one or more processors configured to perform the operations of: receiving, by an autoencoder, an audio signal representation that represents an audio signal and a target echo embedding that comprises information about a target room, wherein the autoencoder comprises an encoder and a decoder; generating, by the encoder, a content embedding and an estimated echo embedding; generating, by the decoder, an echo recording representation based on the content embedding and the target echo embedding; and wherein the echo recording representation represents the audio signal including estimated echo from playing in the target room.

Example 16: The system of Example 15, wherein the target echo embedding encodes information about the geometry of the target room and one or more echo paths.

Example 17: The system of any Examples 15-16, wherein when the target echo embedding is the same as the estimated echo embedding, then the audio signal representation is the same as the echo recording representation.

Example 18: The system of Examples 15-17, wherein the target echo embedding is generated by inputting into the autoencoder a second audio signal representation that represents a second audio signal that was recorded in the target room.

Example 19: The system of Examples 15-18, wherein the autoencoder comprises one or more weights that are learned by training the autoencoder in a Siamese reconstruction network.

Example 20: The system of Examples 15-19, wherein the Siamese reconstruction network comprises two copies of the autoencoder in series, wherein an output of the first copy of the autoencoder comprises an input to the second copy of the autoencoder.

Some portions of the preceding detailed descriptions have been presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities. Usually, though not necessarily, these quantities take the form of electrical or magnetic signals capable of being stored, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "identifying" or "determining" or "executing" or "performing" or "collecting" or "creating" or "sending" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage devices.

The present disclosure also relates to an apparatus for performing the operations herein. This apparatus may be specially constructed for the intended purposes, or it may comprise a general purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, each coupled to a computer system bus.

Various general purpose systems may be used with programs in accordance with the teachings herein, or it may prove convenient to construct a more specialized apparatus to perform the method. The structure for a variety of these systems will appear as set forth in the description above. In addition, the present disclosure is not described with reference to any particular programming language. It will be appreciated that a variety of programming languages may be used to implement the teachings of the disclosure as described herein.

The present disclosure may be provided as a computer program product, or software, that may include a machine-readable medium having stored thereon instructions, which may be used to program a computer system (or other electronic devices) to perform a process according to the present disclosure. A machine-readable medium includes any mechanism for storing information in a form readable by a machine (e.g., a computer). For example, a machine-readable (e.g., computer-readable) medium includes a machine (e.g., a computer) readable storage medium such as a read only memory ("ROM"), random access memory ("RAM"), magnetic disk storage media, optical storage media, flash memory devices, etc.

In the foregoing disclosure, implementations of the disclosure have been described with reference to specific example implementations thereof. It will be evident that various modifications may be made thereto without departing from the broader spirit and scope of implementations of the disclosure as set forth in the following claims. The disclosure and drawings are, accordingly, to be regarded in an illustrative sense rather than a restrictive sense.

What is claimed is:

1. A computer-implemented method for echo recording generation, comprising:

receiving, by an autoencoder, an input comprising an audio signal representation and a target echo embedding, wherein:

the audio signal representation represents an audio signal;

the target echo embedding comprises information about a target room; and the autoencoder comprises an encoder and a decoder;

generating, by the encoder, a content embedding based on the audio signal representation and an estimated echo embedding based on the audio signal representation;

generating, by the decoder, an echo recording representation, wherein the echo recording representation:

is based on the content embedding and the target echo embedding; and comprises a representation of an estimated audio signal that estimates the audio signal being played in the target room, including an estimated echo from playing in the target room; and outputting, by the autoencoder, the echo recording representation and the estimated echo embedding.

2. The method of claim 1, wherein the target echo embedding encodes information about a geometry of the target room and one or more echo paths.

3. The method of claim 1, wherein when the target echo embedding is the same as the estimated echo embedding, then the audio signal representation is the same as the echo recording representation.

4. The method of claim 1, wherein the target echo embedding is generated by inputting into the autoencoder a second audio signal representation that represents a second audio signal that was recorded in the target room.

5. The method of claim 1, wherein the autoencoder comprises one or more weights that are learned by training the autoencoder in a Siamese reconstruction network.

6. The method of claim 5, wherein the Siamese reconstruction network comprises two copies of the autoencoder in series, wherein an output of a first copy of the autoencoder comprises an input to a second copy of the autoencoder.

7. The method of claim 5, wherein the Siamese reconstruction network is trained to minimize reconstruction loss between an input audio signal representation and input echo embedding of the Siamese reconstruction network and an output audio signal representation and output echo embedding of the Siamese reconstruction network.

8. A non-transitory computer readable medium that stores executable program instructions that when executed by one or more computing devices configure the one or more computing devices to perform operations comprising:

receiving, by an autoencoder, an input comprising an audio signal representation and a target echo embedding, wherein:

the audio signal representation represents an audio signal;

the target echo embedding comprises information about a target room; and the autoencoder comprises an encoder and a decoder;

generating, by the encoder, a content embedding based on the audio signal representation and an estimated echo embedding based on the audio signal representation;

generating, by the decoder, an echo recording representation, wherein the echo recording representation:

is based on the content embedding and the target echo embedding; and comprises a representation of an estimated audio signal that estimates the audio signal being played in the target room, including an estimated echo from playing in the target room; and outputting, by the autoencoder, the echo recording representation and the estimated echo embedding.

9. The non-transitory computer readable medium of claim 8, wherein the target echo embedding encodes information about a geometry of the target room and one or more echo paths.

10. The non-transitory computer readable medium of claim 8, wherein when the target echo embedding is the same as the estimated echo embedding, then the audio signal representation is the same as the echo recording representation.

11. The non-transitory computer readable medium of claim 8, wherein the target echo embedding is generated by inputting into the autoencoder a second audio signal representation that represents a second audio signal that was recorded in the target room.

12. The non-transitory computer readable medium of claim 8, wherein the autoencoder comprises one or more weights that are learned by training the autoencoder in a Siamese reconstruction network.

13. The non-transitory computer readable medium of claim 12, wherein the Siamese reconstruction network comprises two copies of the autoencoder in series, wherein an output of a first copy of the autoencoder comprises an input to a second copy of the autoencoder.

14. The non-transitory computer readable medium of claim 12, wherein the Siamese reconstruction network is trained to minimize reconstruction loss between an input audio signal representation and input echo embedding of the Siamese reconstruction network and an output audio signal representation and output echo embedding of the Siamese reconstruction network.

15. An echo recording generation system comprising one or more processors configured to perform the operations of:

receiving, by an autoencoder, an input comprising an audio signal representation and a target echo embedding, wherein:

the audio signal representation represents an audio signal;

the target echo embedding comprises information about a target room; and the autoencoder comprises an encoder and a decoder;

generating, by the encoder, a content embedding based on the audio signal representation and an estimated echo embedding based on the audio signal representation;

generating, by the decoder, an echo recording representation, wherein the echo recording representation:

is based on the content embedding and the target echo embedding; and comprises a representation of an estimated audio signal that estimates the audio signal being played in the target room, including an estimated echo from playing in the target room; and outputting, by the autoencoder, the echo recording representation and the estimated echo embedding.

16. The system of claim 15, wherein when the target echo embedding encodes information about a geometry of the target room and one or more echo paths.

17. The system of claim 15, wherein when the target echo embedding is the same as the estimated echo embedding, then the audio signal representation is the same as the echo recording representation.

18. The system of claim 15, wherein the target echo embedding is generated by inputting into the autoencoder a second audio signal representation that represents a second audio signal that was recorded in the target room.

19. The system of claim 15, wherein the autoencoder comprises one or more weights that are learned by training the autoencoder in a Siamese reconstruction network.

20. The system of claim 19, wherein the Siamese reconstruction network comprises two copies of the autoencoder in series, wherein an output of a first copy of the autoencoder comprises an input to a second copy of the autoencoder.

* * * * *